US005911175A

United States Patent [19]

Sondergeld et al.

[11] Patent Number: 5,911,175

[45] Date of Patent: Jun. 15, 1999

[54] METHOD AND DEVICE FOR CLEANING A PRINTING MACHINE CYLINDER SURFACE

[75] Inventors: Werner Sondergeld, Gross Glienicke; Heike Schneider, Rodgau, both of Germany

[73] Assignee: MAN Roland Druckmaschinen AG, Germany

[21] Appl. No.: 08/802,068

[22] Filed: Feb. 19, 1997

[30] Foreign Application Priority Data

Feb. 24, 1996 [DE] Germany ..... 196 07 037

[51] Int. Cl.[6] ..... B41F 35/00

[52] U.S. Cl. ..... 101/424; 101/483

[58] Field of Search ..... 101/424, 425, 101/423, 483; 15/256.5, 256.51, 256.52; 399/349, 343; 118/70

[56] References Cited

U.S. PATENT DOCUMENTS

| | | | |
|---|---|---|---|
| 3,389,656 | 6/1968 | Giori | 101/424 |
| 3,682,744 | 8/1972 | Person | 101/425 |
| 3,768,433 | 10/1973 | Kumpf | 118/211 |
| 3,792,494 | 2/1974 | Matkan et al. | 399/343 |
| 4,244,200 | 1/1981 | Sando et al. | 118/70 |
| 4,374,745 | 2/1983 | Sibley et al. | 510/400 |
| 4,388,865 | 6/1983 | Kellner | 101/401.1 |
| 4,548,645 | 10/1985 | Thiebaut | 101/451 |
| 4,607,947 | 8/1986 | Ensing et al. | 15/256.52 |
| 4,687,729 | 8/1987 | Cadwell et al. | 101/463.1 |
| 4,765,242 | 8/1988 | Oya et al. | 101/425 |
| 4,784,788 | 11/1988 | Lancz | 510/396 |
| 5,147,028 | 9/1992 | Raggi | 101/425 |
| 5,203,926 | 4/1993 | Bondurant | 134/42 |
| 5,365,849 | 11/1994 | Spiegel | 101/423 |
| 5,627,009 | 5/1997 | Maerz et al. | 430/257 |

FOREIGN PATENT DOCUMENTS

| | | | |
|---|---|---|---|
| 0 419 289 A2 | 3/1991 | European Pat. Off. . | |
| 0 414 909 B1 | 8/1995 | European Pat. Off. . | |
| 28 51 233 | 11/1978 | Germany . | |
| 3401 159 | 1/1984 | Germany . | |
| 42 07 119 | 9/1993 | Germany . | |
| 42 30 567 | 3/1994 | Germany . | |
| 295 15 976 U | 12/1995 | Germany . | |
| 0317772 | 12/1989 | Japan | 101/425 |

OTHER PUBLICATIONS

Miller, "Humidity Insensitive Cleaning Composition For Photoconductive Insulating Surface", Xerox Disclosure Journal, vol. 1 No.9/10, Sep. 1976.

DE–Z "Der Polygraph." Treffpunkt Druckindustrie, 11–94 Seiten 54–56.

*Primary Examiner*—Edgar Burr
*Assistant Examiner*—Anthony H. Nguyen
*Attorney, Agent, or Firm*—Leydig, Voit & Mayer, Ltd.

[57] ABSTRACT

A method and apparatus for cleaning a printing cylinder surface in a printing machine of strongly adhering dirt, such as paper dust and hardened printing ink. This is achieved by applying a predetermined coating of alkaline cleaning agent to the printing cylinder surface by a cleaning roller and allowing the cleaning agent to act on the surface for a defined time, preferably greater than sixty minutes, and then subsequently removing the cleaning agent from the printing cylinder surface by means of a cleaning fluid, such as water.

17 Claims, 2 Drawing Sheets

METHOD AND DEVICE FOR CLEANING A PRINTING MACHINE CYLINDER SURFACE

TECHNICAL FIELD OF THE INVENTION

The present invention relates to printing machines, such as sheet-fed offset printing machines, and more particularly to a method and apparatus for cleaning a printing machine cylinder surface.

BACKGROUND OF THE INVENTION

Cylinders and rollers in printing machines will become soiled upon use with accumulated print residues, such as paper dust, hardened printing ink, or other dirt. It is customary to clean the cylinders or rollers by washing with a cleaning fluid. Conventional cleaning fluids include water or solvents containing hydrocarbons and vegetable-based washing agents.

Several devices for washing printing machine cylinders are known, such as, for example, those disclosed in EP 0 419 289 A2; EP 0 414 909 B1; DE 4,207,119 A1; and DE 4,230,567 A1. As disclosed in DE 4,207,119 A1 and DE 4,230,567 A1, for example, some printing machine cylinders have outer surfaces that include surface structures. The surface structures contain valleys, in which print residues may settle and are no longer susceptible to removal during routine washing. If these print residues are not removed, the printing quality of the printing machine may be adversely affected, particularly in the case of recto/verso printing. In such cases, it may become necessary to change the cylinder dressing or film, or even to replace the printing machine cylinder.

OBJECTS AND SUMMARY OF THE INVENTION

It is an object of the invention to provide a method and apparatus for cleaning a printing machine cylinder surface or a cylinder dressing or film of strongly adhering dirt, such as paper dust and hardened printing inks.

Another object is to provide a method and apparatus for effectively cleaning a printing machine cylinder having surface structures with surface valleys.

Pursuant with the invention, an aqueous alkaline cleaning agent is applied to the printing machine cylinder surface and allowed to remain on the surface for a predetermined length of time prior to applying a cleaning fluid. It has been discovered that the application of an alkaline cleaning agent facilitates the removal of print residues and other dirt from the surface. A method in accordance with the invention comprises the steps of applying an aqueous alkaline cleaning agent to the surface, allowing the cleaning agent to remain on the surface for a predetermined length of time, and washing the surface with a cleaning fluid, which preferably is water or steam.

The cleaning agent may be applied manually, or may be applied automatically, with a cleaning apparatus which comprises an applicator roller and a supply of aqueous alkaline cleaning agent, with the applicator roller being moveable between throw-on and throw-off positions and being formed with a plurality of cleaning agent receiving wells for receiving predetermined quantities of cleaning agent from the supply and for transferring such predetermined quantities of cleaning agent to the cylinder surface. The printing machine further includes a washing device, such as a roller-type washing device, a cloth-type washing device, or a high-pressure washing device for washing the cleaning agent from the surface.

One advantage of the method and apparatus of the invention is that cleaning either can be integrated into the routine cleaning process or can be accomplished when the printing machine is at a maintenance or other standstill. When the machine is at a standstill, the alkaline cleaning agent may be allowed to remain on the surface as long as desired. The effectiveness of the cleaning agent generally will increase with an increase in the length of time that the cleaning agent is allowed to remain on the surface.

BRIEF DESCRIPTION OF THE DRAWINGS

Other objects and advantages of the invention will become apparent upon reading the following detailed description and upon reference to the drawings, in which.

DESCRIPTION OF THE PREFERRED EMBODIMENTS

Figure 1:
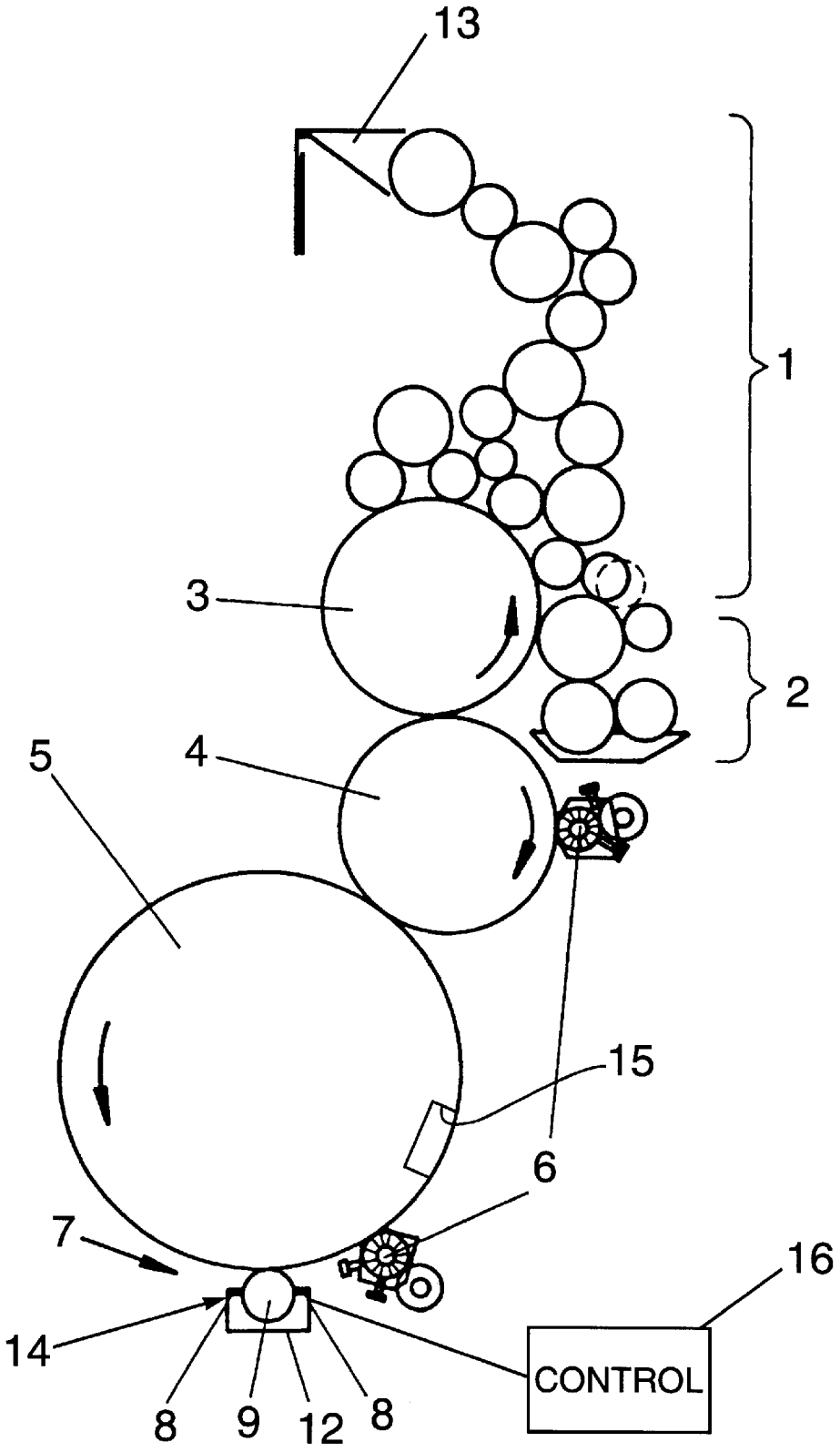
FIG. 1 is a diagrammatic depiction of a printing machine having cylinder cleaning devices in accordance with the present invention.
Figure 2:
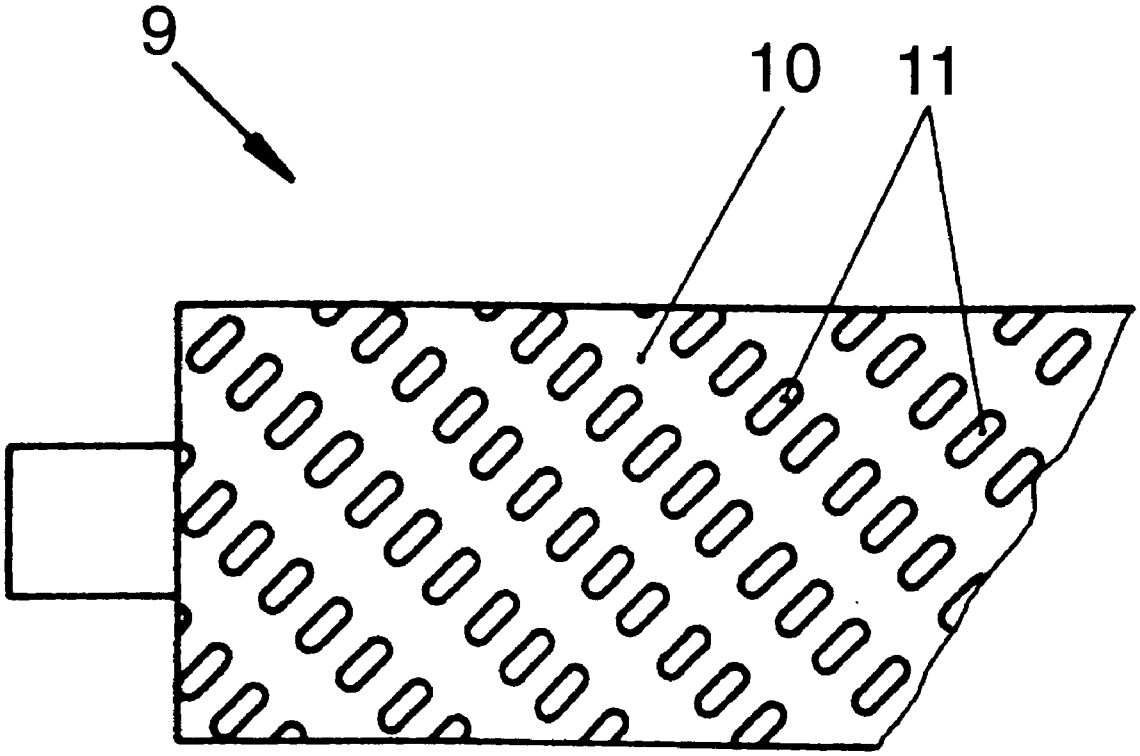
FIG. 2 is an enlarged fragmentary perspective view of a screen roller of the cylinder cleaning device shown in FIG. 1.

While the invention is susceptible of various modifications and alternative constructions, an illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to FIG. 1 of the drawings, there is shown an illustrative printing machine embodying the present invention, which includes an inking unit 1 comprising a train of inking rollers for transmitting ink from an ink fountain 13 to a plate cylinder 3. The plate cylinder 3 communicates with a dampening unit 2 and a rubber blanket cylinder 4, whereupon ink forming a printed image is transferred from the plate cylinder 3 to the rubber blanket cylinder 4. The image is subsequently transferred from the rubber blanket cylinder 4 to an impression cylinder, or printing machine cylinder 5. It will be understood that the printing machine cylinder 5 may be of a conventional type, having a gripper receiving channel 15 formed in the periphery thereof. The rubber blanket cylinder 4 and printing cylinder 5 each possess a washing device 6, which, in the illustrated embodiment, is a conventional brush-roller type. It will be understood that the cleaning device 6 alternatively may be a cloth type washing device, or a high pressure washing device adapted for directing a cleaning fluid to the surface.

In accordance with the invention, an auxiliary cleaning device is provided for selectively applying an aqueous alkaline cleaning agent to the printing cylinder surface which is effective for dislodging difficult to remove dirt and residues on the cleaning cylinder surface, including paper, dust and hardened printing ink that settles into structural valleys and crevices of the printing cylinder surface which are not easily removable by conventional washing devices during routine washing operations. To this end, the printing machine includes an auxiliary cleaning device 7 which includes a power driven applicator roller 9 and an aqueous alkaline cleaning agent supply 14. The cleaning agent supply 14 in this case includes a container 12 into which the aqueous cleaning agent may be directed, such as by appropriate supply conduits, and the applicator roller 9 is disposed partially within the container so as to be in fluid communication with the aqueous alkaline cleaning agent contained therein. It will be understood that the cleaning device 7 is mounted for relative movement with respect to the printing cylinder 5 and may be moved between throw-on and throw-off positions for selective transfer of the aqueous alkaline cleaning agent to the printing cylinder.

In accordance with the preferred embodiments of the invention, the cleaning agent is an aqueous alkaline cleaning gel comprising an inorganic lye and a thickener, and optionally including an ether or glycol ether, a thickener, and/or a surfactant. The cleaning agent may be made according to one of the following recipes:

Recipe 1

Inorganic lye (preferably 10–25% by weight NaOH) Ether (preferably 2–10% by weight 1-methoxy-2-propanol) Surfactant Thickener Recipe 2

Inorganic lye (preferably 10–25% by weight NaOH) Surfactants Thickener

Recipe 3

Inorganic lye (preferably 10–25% by weight NaOH) Thickener Although the invention is described with respect to application of the cleaning agent directly to the surface of the printing cylinder, it will be understood by those skilled in the art that the cleaning agent may equally be applied to a cylinder having a dressing or film on the printing cylinder surface.

In keeping with the invention, the applicator roller 9 is a screen roller having an elastomeric surface formed with a plurality of webs 10 that define a multiplicity of wells 11, which each are adapted for receiving a predetermined quantity of cleaning agent from the supply 14 and for transferring such predetermined quantity to the surface of the printing cylinder 5.

For monitoring such predetermined transfer of alkaline cleaning agent from the supply 14 to the printing cylinder surface, the container 12 includes doctor blades 8 disposed on opposite sides of the applicator roller 9 so as to function as working and closing doctors, depending on the direction of rotation of the applicator roller 9. The doctor blades 8 alternately may be adapted for relative throw-on and off movement with respect to the applicator roller. During rotational driving movement of the applicator roller 9, it will be seen that the doctor blades 8 limit the volume of cleaning agent transferred by the applicator roller to the printing surface to that amount which is carried by the wells 11 in the surface of the applicator roller.

In further carrying out the invention, to effect such predetermined control and application of the aqueous alkaline cleaning fluid to the printing cylinder, an angle correlated machine control 16 is provided for controlling the application based upon rotational position of the printing cylinder 5. The cleaning agent preferably is applied for at least one revolution of the printing machine cylinder 5, which will be sufficient to apply a layer of cleaning agent. If a thicker layer of cleaning agent is desired, the cleaning agent may be applied over more than one revolution of the printing machine cylinder, depending on the applicator roller used and on the thickness of the layer of the alkaline cleaning agent to be applied.

In use, the printing machine cylinder surface preferably is pre-cleaned with the washing device 6 in a conventional manner. Following such pre-cleaning, the applicator roller 9 of the auxiliary cleaning device 7 may be thrown into operative engagement with the printing cylinder surface so as to transfer a predetermined coating and quantity of such cleaning agent is applied about the surface of the printing cylinder 5 aqueous alkaline agent to the cylinder surface.

When the surface of the printing machine cylinder 5 is covered with cleaning agent in the amount desired, the cleaning device 7 is thrown off, and the printing machine cylinder 5 is stopped. The cleaning agent, which forms a gel-like film on the surface, is allowed to remain on the surface for a predetermined length of time, preferably, for at least sixty minutes. For example, the cleaning agent may be allowed to remain on the surface for about two hours. It will be understood that the time may vary according to the specific composition of the alkaline cleaning agent and the condition of the printing cylinder surface to be cleaned. Although a specific theory of operation is not entirely understood, it is believed that the lye in the cleaning agent chemically reduces the print residues and other dirt on the surface of the printing cylinder 5.

After the predetermined time setting has ended, the washing device 6 is thrown onto the surface of the printing machine cylinder 5, and cleaning fluid is applied to wash off the cleaning agent. A separate conduit system may be provided for discharge of the washed fluid.

From the foregoing, it can be seen that the method and apparatus of the present invention are adapted for cleaning printing cylinder surfaces, or cylinder dressings or films thereon, of strongly adhering dirt, such as paper, dust, hardened printing inks, and the like, which heretofore have not been easily removable by conventional washing devices.

What is claimed is:

1. A method for cleaning a surface structure of a printing cylinder of a sheet-fed offset printing machine, the surface structure having a plurality of valleys in which dirt and print residues such as hardened ink settle, the method comprising the steps of:

applying a gel-like aqueous alkaline cleaning agent to said printing cylinder surface structure such that a portion of said cleaning agent settles in said valleys;

allowing said cleaning agent to remain on said surface until said print residues and dirt are removed from said valleys in said surface structure; and washing said cleaning agent from said surface with a cleaning fluid.

2. A method according to claim 1, wherein said cleaning agent is allowed to remain on said surface at least sixty minutes.

3. A method according to claim 1, wherein said cleaning agent comprises an inorganic lye and a thickener.

4. A method according to claim 3, wherein said cleaning agent contains a surfactant.

5. A method according to claim 3, wherein said cleaning agent contains an ether.

6. A method according to claim 5, wherein said ether is 1-methoxy-2-propanol.

7. A method according to claim 3, wherein said inorganic lye is NaOH.

8. A method according to claim 3, wherein said inorganic lye is present in an amount ranging from about 10% to about 25% by weight.

9. A method according to claim 1, wherein said cleaning fluid is a vegetable-based washing agent.

10. A method for cleaning a surface structure of a printing cylinder of a sheet-fed offset printing machine, the surface structure having a plurality of valleys in which dirt and print residues such as hardened ink settle, the method comprising the steps of:

washing said surface structure of said printing cylinder with a cleaning fluid;

applying a gel-like aqueous alkaline cleaning agent to said printing cylinder surface structure such that a portion of said cleaning agent settles in said valleys;

allowing said cleaning agent to remain on said surface until said print residues and dirt are removed from said valleys in said surface structure; and washing said cleaning agent from said surface with a cleaning fluid.

11. A printing machine comprising a printing cylinder having a surface structure having a plurality of valleys therein in which dirt and print residues settle, a cleaning device associated with said printing cylinder, said cleaning device including an applicator roller and a supply of aqueous alkaline cleaning agent, said cleaning agent supply being in fluid communication with said applicator roller, a metering device for regulating the transmission of said cleaning agent to said applicator roller, said applicator roller being mounted adjacent the printing cylinder so as to be selectively moveable between a throw-off position wherein said applicator roller is out of contact with said printing cylinder and a throw-on position wherein said applicator roller operatively engages said printing cylinder so as to transmit said alkaline cleaning agent to the surface structure of said printing cylinder such that a portion of said cleaning agent settles in said valleys in said structure during a cleaning operation.

12. A printing machine according to claim 11 wherein said applicator roller is a screen roller having a plurality of webs on the surface thereof which define a plurality of cleaning agent containing wells for receiving predetermined quantities of cleaning agent from said supply and for transferring said predetermined quantities of cleaning agent to said cylinder surface.

13. A printing machine according to claim 11 wherein said supply includes a container for receiving the cleaning agent, and said applicator roller is disposed within said container in fluid communication with the cleaning agent contained therein.

14. A printing machine according to claim 13 wherein said metering device comprises a doctor blade disposed in adjacent relation to the applicator roller.

15. A printing machine according to claim 11 wherein said metering device includes doctor blades disposed on opposite sides of said applicator roller.

16. A printing machine according to claim 11 including a second cleaning device for cleaning alkaline cleaning agents from said cylinder surface.

17. A method for cleaning dirt and print residue such as hardened ink from a surface of a printing machine cylinder, the method comprising the steps of:

washing said cylinder with a cleaning fluid, applying an aqueous alkaline cleaning agent to said surface;

allowing said cleaning agent to remain on said surface for a predetermined length of time sufficient to facilitate removal of said print residues and dirt from said surface structure; and washing said cleaning agent from said surface with a cleaning fluid.

* * * * *